US011976575B2

(12) United States Patent
Gaia et al.

(10) Patent No.: US 11,976,575 B2
(45) Date of Patent: May 7, 2024

(54) CASCADE ORGANIC RANKINE CYCLE PLANT

(71) Applicant: TURBODEN S.P.A., Brescia (IT)

(72) Inventors: Mario Gaia, Brescia (IT); Roberto Bini, Brescia (IT); Claudio Pietra, Brescia (IT)

(73) Assignee: TURBODEN S.P.A., Brescia (IT)

( * ) Notice: Subject to any disclaimer, the term of this patent is extended or adjusted under 35 U.S.C. 154(b) by 0 days.

(21) Appl. No.: 17/927,982

(22) PCT Filed: May 26, 2021

(86) PCT No.: PCT/IB2021/054564

§ 371 (c)(1),
(2) Date: Nov. 28, 2022

(87) PCT Pub. No.: WO2021/240379

PCT Pub. Date: Dec. 2, 2021

(65) Prior Publication Data

US 2023/0220789 A1 Jul. 13, 2023

(30) Foreign Application Priority Data

May 29, 2020 (IT) ..... 102020000012907

(51) Int. Cl.

| | |
|---|---|
| ***F01K 25/10*** | (2006.01) |
| ***F01K 7/18*** | (2006.01) |
| ***F01K 23/02*** | (2006.01) |
| ***F01K 25/08*** | (2006.01) |

(52) U.S. Cl.
CPC ..... *F01K 25/10* (2013.01); *F01K 7/18* (2013.01); *F01K 23/02* (2013.01); *F01K 25/08* (2013.01)

(58) Field of Classification Search
CPC . F01K 7/18; F01K 23/02; F01K 25/08; F01K 25/10
See application file for complete search history.

(56) References Cited

FOREIGN PATENT DOCUMENTS

DE 202007012871 U1 * 12/2007 ..... F01K 25/08
DE 202007015236 U1 * 2/2008 ..... F01K 23/02

* cited by examiner

*Primary Examiner* — Audrey B. Walter
(74) *Attorney, Agent, or Firm* — R. Ruschena Patent Agent, LLC

(57) ABSTRACT

An organic Rankine cycle system with cascade cycles provided with a first organic Rankine cycle which operates at high temperature, in which a first organic working fluid carries out a heat exchange with a hot source fluid and a second organic Rankine cycle which operates at a temperature lower than the temperature of the first organic Rankine cycle and in which a second organic working fluid carries out a heat exchange with the same hot source. The evaporator of the first organic Rankine cycle is fed by the entire flow rate of the hot source fluid, while the evaporator and the preheater of the second organic Rankine cycle are fed by a first partial flow of the hot source fluid, the remaining second partial flow of the hot source fluid being used to partially carry out the preheating of the organic working fluid of the first organic Rankine cycle.

8 Claims, 5 Drawing Sheets

CASCADE ORGANIC RANKINE CYCLE PLANT

FIELD OF THE INVENTION

The present invention relates to an organic Rankine cycle plant (ORC), the peculiar characteristics of which allow to obtain a high yield of the same cycle.

BRIEF DESCRIPTION OF THE PRIOR ART

As is well known, a thermodynamic cycle is defined as a finite succession of thermodynamic transformations (for example isotherm, isochore, isobaric or adiabatic transformations) at the end of which the system returns to its initial state. In particular, an ideal Rankine cycle is a thermodynamic cycle consisting of two adiabatic transformations and two isobars, with two phase changes: from liquid to vapor and from vapor to liquid. Its purpose is to turn heat into work. This cycle is generally mainly adopted in thermoelectric power plants for the production of electric power and uses water as the motor fluid, both in liquid form and in the form of steam, with the so-called steam turbine.

Furthermore, plants are known based on an organic Rankine cycle (ORC) for the conversion of thermal energy into mechanical and/or electrical energy. In these plants, organic (high or medium molecular weight) working fluids are used instead of the traditional water/steam system, as an organic fluid is able to convert heat sources more efficiently at relatively low temperatures, generally of 100° C. and 300° C., but also at higher temperatures. The ORC conversion systems are therefore finding ever wider applications in different fields, for example in the geothermal field. A known type of plant for the conversion of thermal energy through an organic Rankine cycle (ORC) in general comprises: at least one heat exchanger that changes heat between a high-temperature hot source and an organic working fluid, so as to heat up, evaporate (and possibly overheat) the working fluid; at least one turbine powered by the working fluid in vapor phase exiting the heat exchanger, so realizing a conversion of a thermal energy present in the working fluid into a mechanical energy according to a Rankine cycle; at least one generator operatively connected to the turbine, in which the mechanical energy produced by the turbine is converted into electrical energy; at least one condenser in which the working fluid exiting the turbine is condensed and sent to at least one pump. From the pump the working fluid is sent to the heat exchanger for beginning a new thermal cycle.

For issues related to a correct sizing of the machines, to avoid high pressures, or in any case to exploit other favorable characteristics of organic fluids, it is often preferred to refer to a scheme with multiple levels of pressure and/or temperature.

In fact, cascade cycles are known, in which the fluid of the upper cycle transfers heat to the fluid of the lower cycle (where the two working fluids are different to better adapt to the different temperatures of the upper cycle compared to the lower one), or cycles at multiple pressure levels and/or temperature which have the purpose of better accompanying the cooling of the hot source (i.e. with small delta T between the heat transfer curve of the hot-source and that of heat reception of the organic fluid).

A widely adopted scheme since the 1980s is a dual level plant scheme, such as the one described, for example, in GB2162583A. The described cycle is called "cascade" with reference this time to the fact that 2 ORC systems are placed in series (or in cascade) with respect to the heat source. This scheme uses different levels of temperature (and pressure, in case the working fluid is the same in the 2 systems) allowing a better exploitation of the heat source. In other words, this cascade cycle uses a plurality of Rankine cycle modules, each having an associated heat exchanger, the source fluid being applied in series to the exchangers of each module in order to maximize the net power produced by the system. Typically, in case of two modules, they will be referred to as high temperature cycle and low temperature cycle.

With reference to the cited document, in a cascade cycle according to the known art, the hot source first feeds the vaporizer of the high temperature cycle. The high-temperature vaporizer performs both a preheating of the organic fluid and its vaporization (and possibly also its overheating) and can be made in a single container (as in document GB2162583A) or in two different containers (as in similar document EP2217793). The hot source then passes through the vaporizer of the low temperature cycle and subsequently it is divided into two streams that feed two partial preheaters of the high temperature cycles and low temperature.

The prior art documents reported above refer to a two-level cycle, but the same principle can be applied to a greater number of "levels".

Therefore, a technique to increase power is to extract more heat from the source fluid by increasing the fall of overall temperature at the end of the thermal exchanges and at the same time trying to keep as high as possible the steam generation temperature that feeds the turbine/s, to keep high the conversion efficiency of heat into mechanical energy. A multi-level temperature system already performs this task better than a single-level subcritical cycle.

The problem still to be solved concerns the further optimization of the mechanical conversion efficiency in an ORC cycle in applications in which the flow rate and temperature characteristics of the thermal source in relation to the usable organic fluids do not find an ideal solution in the known art, for example in some geothermal applications or heat recovery. There is therefore the need to further optimize the efficiency of an organic Rankine cycle to improve the economic yield in particular of geothermal plants often heavily penalized by high costs for the construction of plant engineering works and for which therefore an increase in electricity production is of significant help, together, of course, with a simplification of the systems and a consequent reduction in constructive and management costs.

SUMMARY OF THE INVENTION

The object of the present invention is therefore an organic Rankine cycle plant with cascade cycles, capable of increasing the overall efficiency of the plant. More particularly, as will be seen in what follows, the present invention proposes to solve the drawbacks present in the embodiments according to the prior art, namely: to improve the thermodynamic efficiency, to simplify the system from a constructive point of view of the plant, to reduce the construction cost of the plant itself.

According to the present invention, therefore, is described, an organic Rankine cycle plant with cycles in cascade with respect to the thermal source, having the characteristics set out in the appended independent claim.

Additional preferred and/or particularly advantageous ways of implementing the above-mentioned plant are described according to the characteristics set out in the appended dependent claims.

BRIEF DESCRIPTION OF THE DRAWINGS

The invention will now be described with reference to the attached drawings, which illustrate some non-limiting examples of embodiment, in which.

DETAILED DESCRIPTION OF THE PREFERRED EMBODIMENTS

Figure 1:
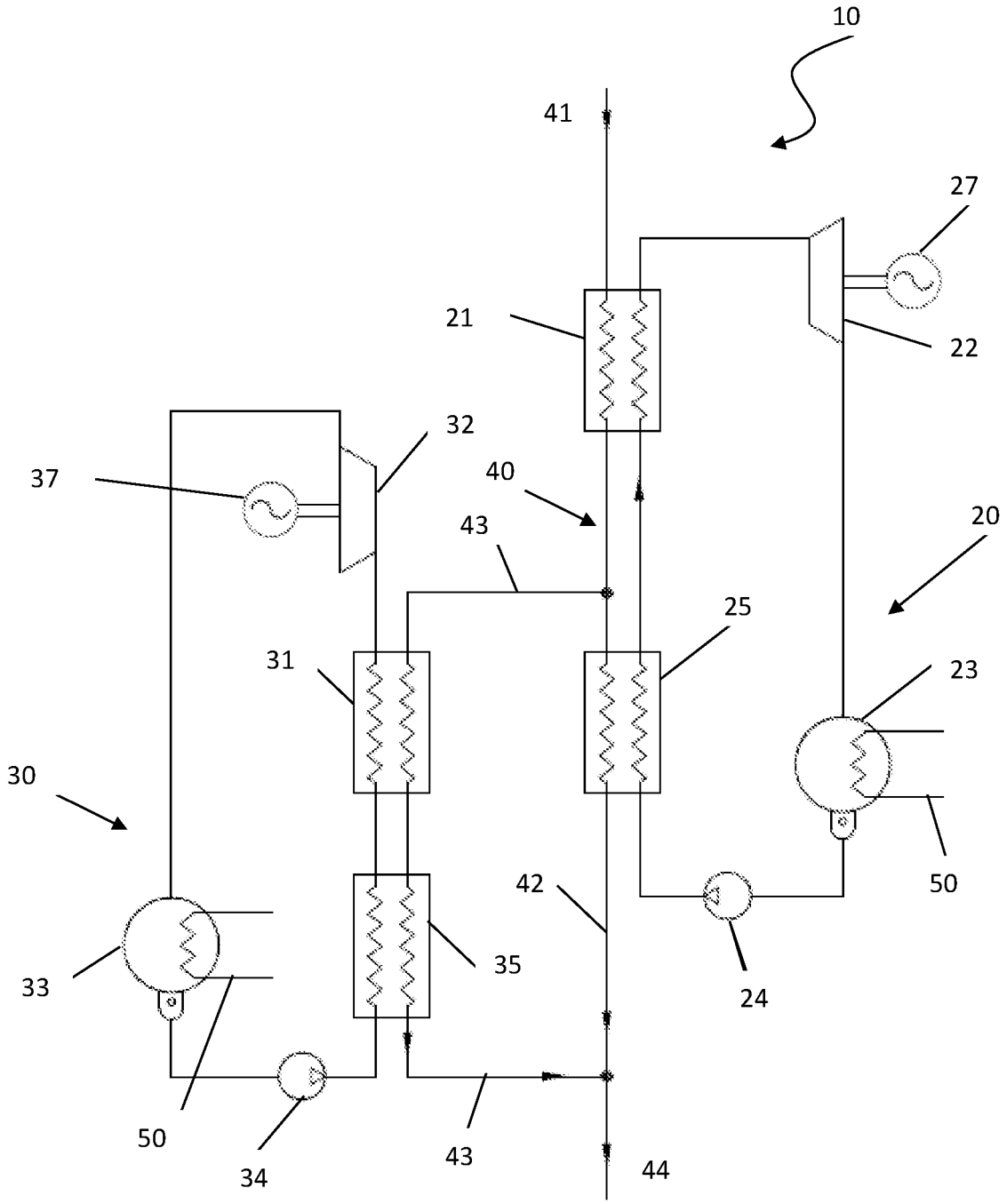
FIG. 1 shows a ORC plant scheme according to a first embodiment of the present invention.

Referring now to FIG. 1, hereinafter a system 10 is described having two cycles with a first ORC cycle 20 at a high temperature and a second ORC cycle 30 at a lower temperature. In the diagram in FIG. 1 the two expansion turbines 22, 32 (hereinafter simply turbines) are fed by two different evaporators 21, 31 and with two different working fluids, but what is proposed could also be applied:

- to a scheme with two or more evaporation levels, by using a single working fluid,
- to a scheme with more than two evaporators supplying more than two turbines, with different fluids,
- to a scheme in which the expansion turbine is replaced by a volumetric or hybrid expander, or a partly volumetric and partly turbine expander.

In the plant 10 the first ORC 20 cycle, at high temperature, comprises an evaporator 21 in which a first organic working fluid is brought to evaporation (and possibly to a subsequent superheating not shown in the figure), a turbine 22 in which the steam of the first organic fluid is expanded, being the turbine 22 operatively connected to an electric generator 27, a condenser 23 (e.g., a condenser whose cold source 50 is air) in which the working fluid is condensed and returns to the liquid state, a supply pump 24 which compresses the organic working fluid and sends it to a pre-heater 25 and then to the evaporator 21 for a new thermodynamic cycle.

The second ORC cycle 30, at low temperature or in any case at a temperature lower than the first ORC cycle 20, comprises an evaporator 31 in which a second organic working fluid is led to evaporation (and possibly to a subsequent superheating not indicated in figure), a turbine 32 in which the steam of the first organic fluid is expanded, being the turbine 32 operatively connected to a gene electric operator 37, a condenser 33 (for example, a condenser whose cold source 50 is air) in which the working fluid is condensed and returns to the liquid state, a supply pump 34 which compresses the organic working fluid and sends it to a pre-heater 35 and then to the evaporator 31 for a new thermodynamic cycle.

The fluid of the hot source, for example, a geothermal source, follows a path for heat exchange with both ORC cycles. After entering the plant 10 at the entry point 41, it crosses with the whole of its flow 40 the evaporator 21 of the first ORC cycle 20.

It should be remembered that by an evaporator a heat exchanger is meant that receives an organic working fluid in a liquid state and at a temperature close to that of evaporation. The difference between the evaporation temperature and the inlet temperature of the organic working fluid to be evaporated is defined with the term "approach". Normally in an evaporator the thermal power to be supplied to evaporate the organic working fluid is strongly preponderant with respect to the thermal power to be supplied to complete the preheating of the fluid, being the approach only equal to few degrees centigrade.

At the exit from this first evaporator 21, the fluid of the hot source is divided into two flow rates: a first partial flow rate partial 43 is dependent from the second ORC cycle 30 and supplies in cascade the evaporator 31 and the pre-heater 35 of the second ORC cycle 30, whereas a second partial flow rate 42 remains dependent from the first ORC cycle 20 and supplies the pre-heater 25 of the first ORC cycle 20. Finally, the partial flow rate 43 of the cycle 30 and the partial flow rate 42 of the cycle 20 join together to form the full flow rate 40 which leaves the plant at the outlet point 44.

Preferably the working fluids of the two ORC cycles 20, 30 are different. A suitable choice of the two fluids allows to optimize the overall conversion efficiency, as it is possible to use fluids with different critical points (which are typically lower for the cycle at a lower temperature) and/or a more compressed fluid (i.e. with higher evaporation pressures) for the lowest temperature cycle. For this cycle, in fact, the adoption of the same fluid of the higher temperature cycle would lead to too low operating pressures and therefore, for example, to specific volumes and too large volumetric flow rates with consequent bad dimensioning of the turbine.

The choice of the quantity of source fluid to be divided between the two cycles is optimized on the basis of the temperature profile of the source in relation to the heat introduction curves in the two organic fluids.

Figure 2:
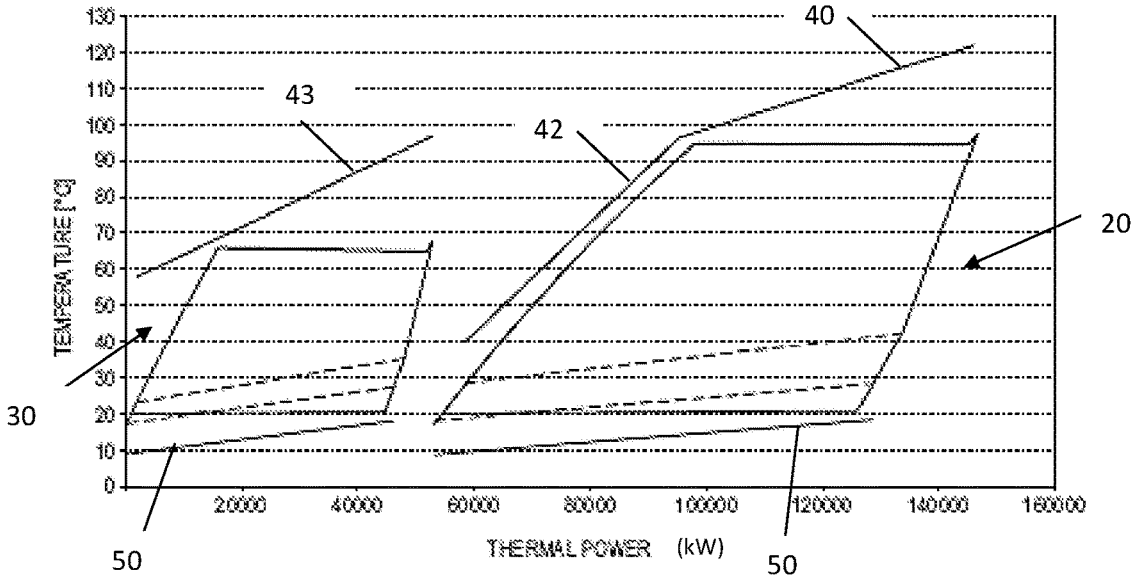
FIG. 2 shows a graph of the temperature/power of the system of FIG. 1.

In FIG. 2 in a temperature-thermal power diagram, the thermodynamic cycle is shown corresponding to the schematic plant of FIG. 1. In particular FIG. 2 (by using the same references of the plant scheme of FIG. 1) shows the thermodynamic transformations of the hot source 40, 42, 43, of the first ORC cycle 20 at a high temperature, of the second cycle ORC 30 at a lower temperature and of the cold source 50.

The changes in slope (i.e. of the flow rates in a temperature–thermal power diagram) corresponding to the flow split of the reference diagram are highlighted as follows: the partial flow rate 42 at the exit of the evaporation phase has a greater slope (lower flow rate) than the flow rate 40 so as the partial flow rate 43 (i.e., its slope) is lower than flow rate 40.

Figure 3:
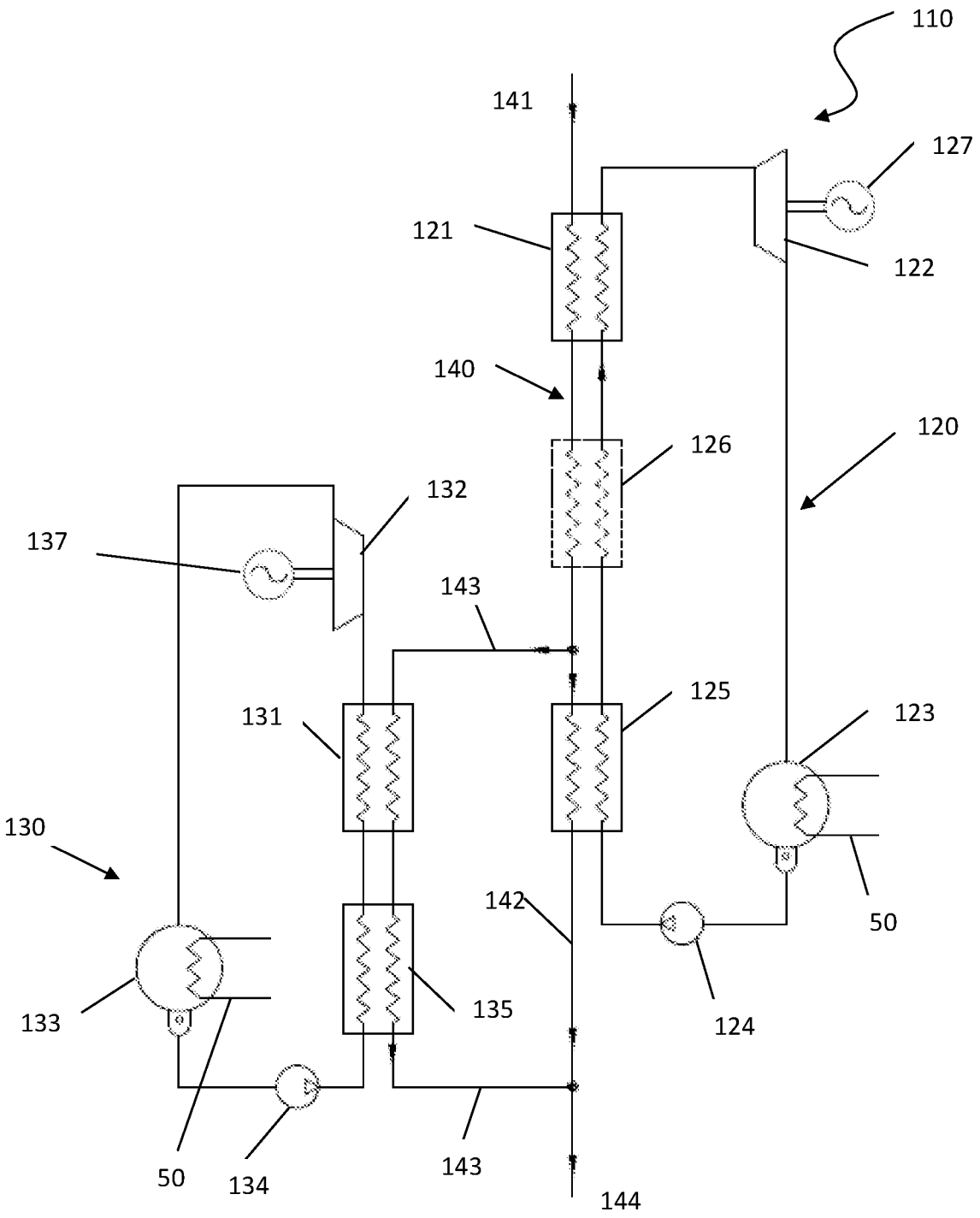
FIG. 3 shows a ORC plant scheme in a second embodiment of the present invention.

A variant of the diagram of FIG. 1 is shown in FIG. 3. Also in this case a two-cycle plant 110 is described with a first ORC cycle 120 cycle at high temperature and a second ORC cycle 130 at a lower temperature. Similarly, the two turbines 122, 132 are supplied by two different evaporators 121, 131 and with two different working fluids, but what is proposed could also be applied:

- to a scheme with two or more evaporation levels, using a single working fluid,
- to a scheme with more than two evaporators supplying more than two turbines, with different fluids.

In the plant 110 the first ORC cycle 120, at high temperature, corresponds to the previous first ORC cycle 20 examined in FIG. 1 except for the fact that it also comprises a second pre-heater 126. Therefore, the first ORC cycle 120 comprises an evaporator 121 in which a first organic working fluid is brought to evaporation (and possibly to a subsequent overheating not shown in the Figure), a turbine 122 in which the vapor of the first organic fluid is expanded, being the turbine 122 operatively connected to an electric generator 127, a condenser 123 (i.e. a condenser in which the cold source 50 is air) in which the working fluid is condensed and returns to the liquid state, a supply pump 124 which compresses the organic working fluid and sends it to a first pre-heater 125. The organic working fluid then passes through the second pre-heater 126 then reaching the evaporator 121 for a new thermodynamic cycle.

As previously explained, by an evaporator a heat exchanger is meant which receives an organic working fluid in the liquid state and at a temperature close to that of evaporation. The difference between the evaporation temperature and the inlet temperature of the organic working fluid to be evaporated is defined "approach".

Normally in an evaporator the thermal power to be supplied to evaporate the organic working fluid is strongly dependent with respect to the thermal power to be supplied to complete the preheating of the fluid, being approach only equal to few degrees centigrade. This definition applies to the evaporator 121 (as well as to the previous evaporator 21), whereas the second pre-heater 126 is a heat exchanger having a substantial function of an additional pre-heater, not being intended to evaporate the fluid but to preheat it with an increasing temperature greater than a few degrees centigrade (typically 2-5° C.) with respect to the "approach" described above made either for the evaporator 21 (or for the evaporator 121).

The second ORC cycle 130, at low temperature or in any case at a temperature lower than the first ORC cycle 120, comprises, as in the example of FIG. 1, an evaporator 131 in which a second organic working fluid is brought to evaporation (and possibly to a subsequent overheating), a turbine 132 in which the vapor of the second organic fluid is expanded, being the turbine 132 operatively connected to a electric generator 137, a condenser 133 (i.e. a condenser the cold source 50 of which is air) in which the working fluid is condensed and returns to the liquid state, a supply pump 134 which compresses the organic working fluid and sends it to a pre-heater 135 and then to the evaporator 131 for a new thermodynamic cycle.

The fluid of the hot source, for example a geothermal source, follows, as in the previous case, a path of thermal exchange with both ORC cycles. After being entered in the plant 110 at the entry point 141, it crosses with its whole flow rate 140 the evaporator 121 and the second pre-heater 126 of the first cycle ORC 120.

At the exit from the second pre-heater 126, the fluid of the hot source is divided into two flow rates: a first partial flow rate 143 is dependent from the second ORC cycle 130 and supplies, in cascade, the evaporator 131 and the pre-heater 135 of the second ORC cycle 130, whereas a second partial flow rate 142 is still dependent from the first ORC cycle 120 and supplies the first pre-heater 125 of the first ORC cycle 120. Finally, the partial flow rate 143 of the cycle 130 and the partial flow rate 142 of the cycle 120 join to form the full flow rate 140 leaving the plant at the exit point 144.

Figure 4:
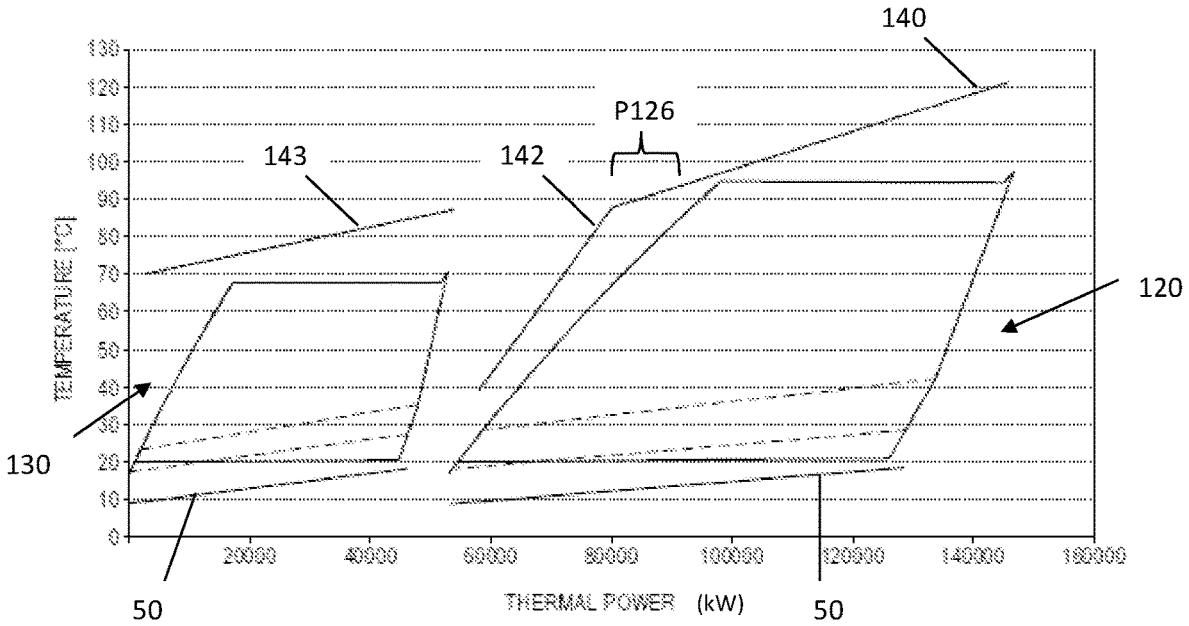
FIG. 4 shows a graph of the temperature/power of the system of FIG. 3.

In FIG. 4 in a temperature-thermal power diagram, the thermodynamic cycle is shown corresponding to the plant scheme of FIG. 3. In particular FIG. 4 (by using the same references of the plant scheme of FIG. 3) shows the thermodynamic transformations of the hot source 140, 142, 143, of the first ORC cycle 120 at high temperature, of the second ORC cycle 130 at a lower temperature and of the cold source 50. The changes in slope (i.e. of the flow rate in a temperature–thermal power diagram) corresponding to the flow split of the reference diagram are highlighted as follows: the partial flow rate 142 at the exit of the preheating phase (pre-heater 126 in FIG. 3) has a greater slope (i.e., a lower flow rate value) than the flow rate 140 as well as the partial flow rate 143 (i.e. its slope) is lower than the flow rate 140. It should be noted that in FIG. 4 the preheating phase at full flow rate P126 carried out by the pre-heater 126 is highlighted.

In this way, in relation to the working fluids used in the two cycles, the further optimized solution object of the present invention can be obtained.

As already mentioned, the invention also includes numerous other variants, among which, for purely illustrative purposes, some of them are highlighted.

First of all, the organic working fluids can be the same both for the first ORC cycle 20 at a high temperature and for the second ORC cycle 30 at a lower temperature, as in the scheme of FIG. 1, or both for the first ORC cycle 120 at high temperature and for the second ORC cycle 130 at lower temperature, as in the scheme of FIG. 3. According to this variant, therefore, the same organic working fluid supplies either the two distinct turbines 22, 32 of the plant 10 or the two distinct turbines 122, 132 of the plant 110. In any case, should it be possible to obtain good cycle-source couplings and would the thermodynamic pressure and temperature conditions of the two ORC cycles allow a satisfactory sizing of the apparatus, the management of a single organic working fluid involves a further plant simplification and allows a further cost reduction.

According to another embodiment, the electrical generator plant could be single and the two turbines could be both connected to the single electrical generator. Referring to FIG. 1, for example, both turbines 22, 32 could be connected to the generator 27, just as, with reference to FIG. 3, both turbines 122, 132 could be connected to the generator 127. This embodiment also implies evidently a plant simplification and cost savings.

Figure 6:
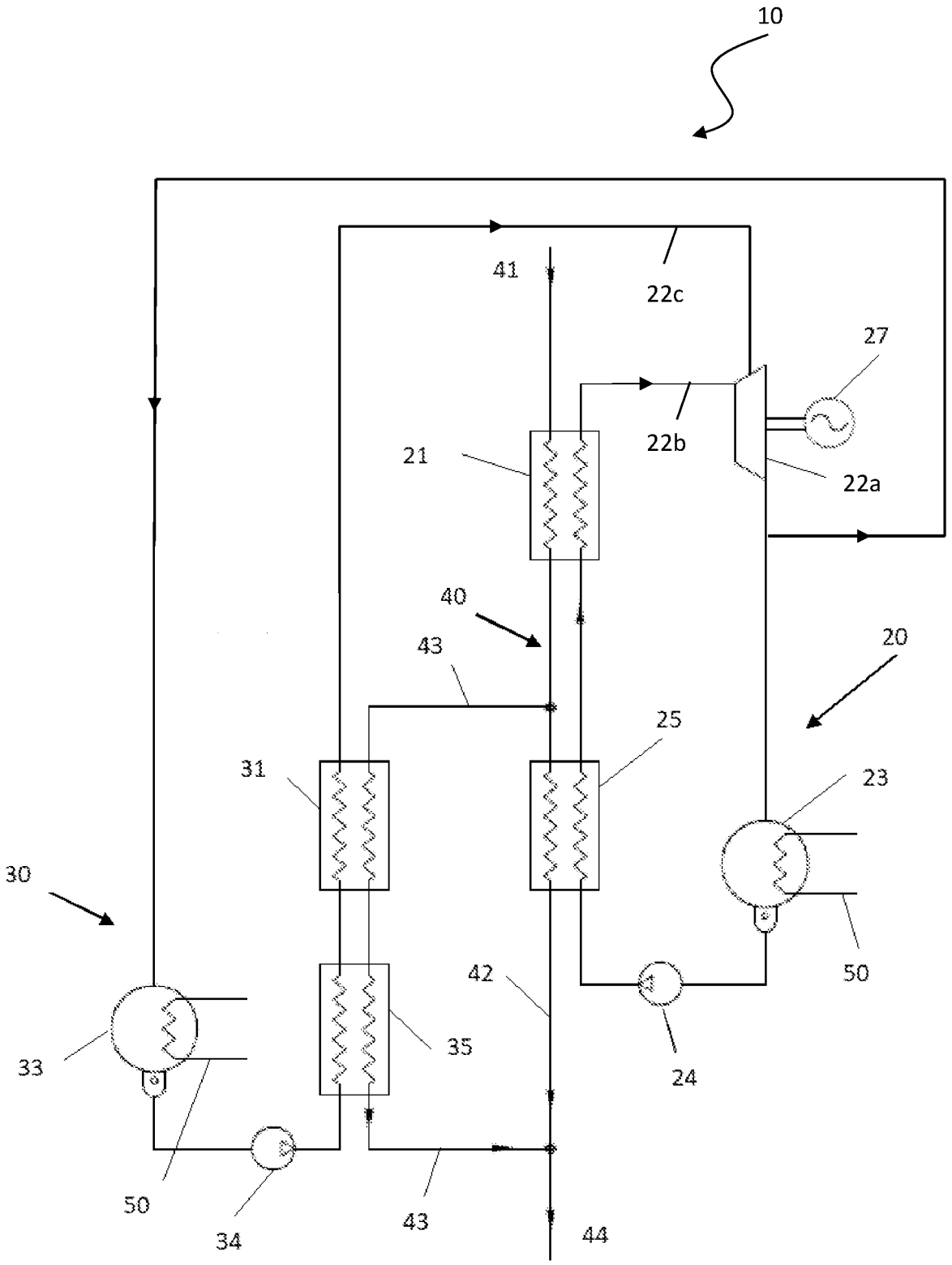
FIG. 6 illustrates an additional embodiment of a single turbine with two feeding levels.

Indeed, instead of two turbines, have a single turbine 22*a* could be used with two pressure supply levels 22*b*, 22*c* (see FIG. 6): evidently in this case the working fluid of the two cycles 20 and 30 (or of the two cycles 120 and 130) must be the same. The fluid coming from the evaporator 21 (or from the evaporator 121) supplies the high pressure inlet of the turbine 22*a* whereas a suitable intermediate section (therefore during the expansion, or at a lower pressure) of said turbine would be powered by the fluid coming from the second evaporator 31 (or from the second evaporator 131)".

The solution of the double turbine entry has already been invented by the writer and is disclosed, for example, in document EP3455465. A further variant consists in providing a regeneration phase for the two cycles 20, 120 at high temperature and/or for the two cycles 30, 130 at a lower temperature. As is known, by a regeneration a heat exchange is meant which is carried out in a dedicated heat exchanger (regenerator) in which the expanded vapor of the organic working fluid coming from the turbine transfers heat to the same organic fluid in liquid phase coming from the supply pump to upstream of the pre heater or the pre-heaters.

Figure 5:
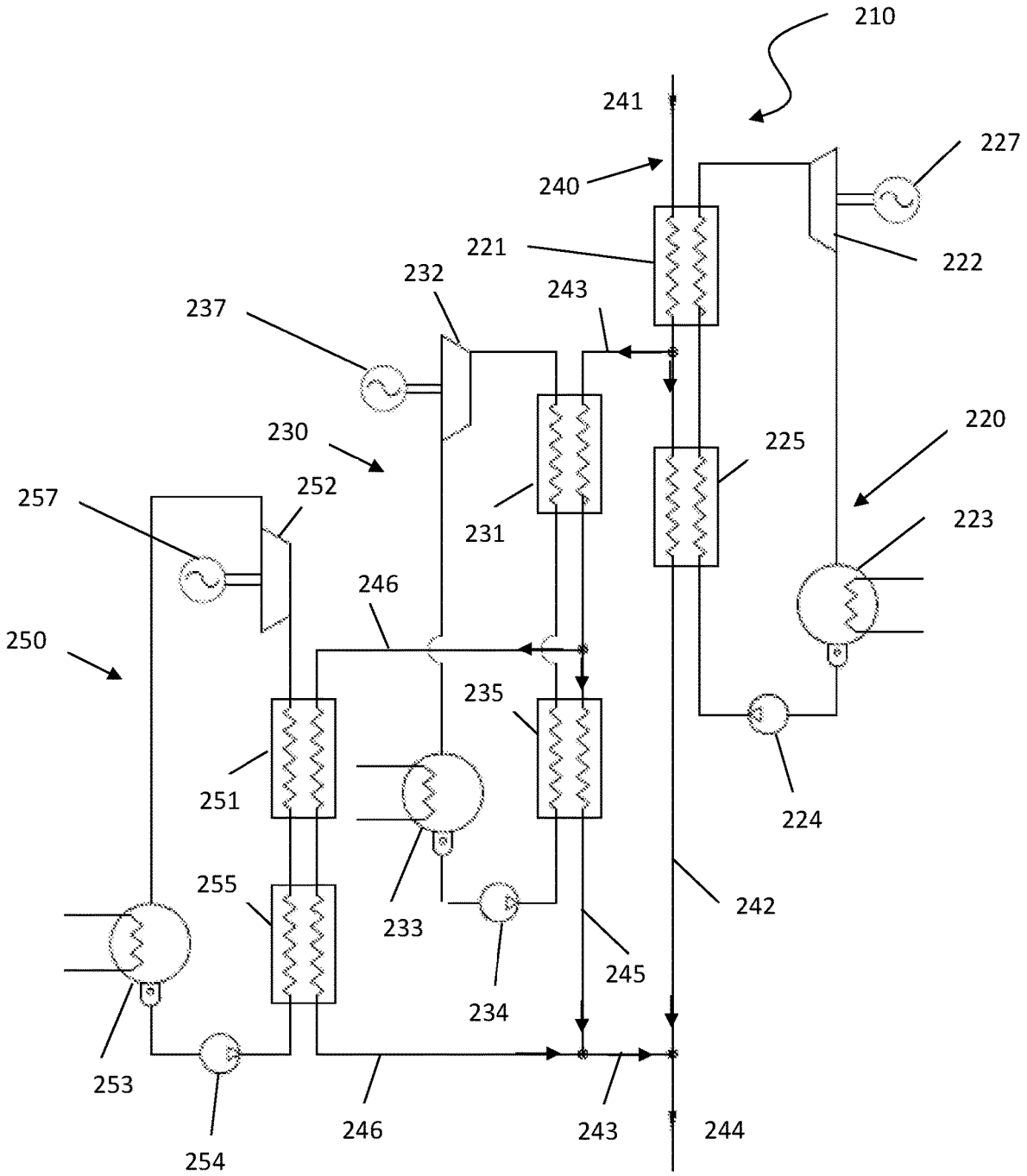
FIG. 5 illustrates a third embodiment of the present invention.

In addition, should the plant needs require it, the schemes of FIG. 1 and FIG. 3 can also be applied to a number of organic cycles greater than two, as shown in FIG. 5. In this Figure, in fact, the plant 210 comprises three organic Rankine cycles 220, 230, 250, at mutually different temperatures, all consisting, as in FIG. 1, of an evaporator 221, 231, 251, a turbine 222, 232, 252 operatively connected to an electric generator 227, 237, 257, a condenser 223, 233, 253, a supply pump 224, 234, 254 which compresses the organic working fluid and sends it to a pre-heater 225, 235, 255 and then back to evaporator 221, 231, 251 for a new thermodynamic cycle.

Similarly to what has been seen in the diagram of FIG. 1 with two organic Rankine cycles, the fluid of the hot source follows a heat exchange path with all three ORC cycles. After entering the system 210 at the entry point 241, it crosses with its entire flow rate 240 the evaporator 221 of the first ORC cycle 220. At the exit from this evaporator 221, the fluid of the hot source is divided into two flow rates: a first partial flow rate 243 and a second flow rate 242. The first flow rate 243 is dependent from the second ORC cycle 230 and supplies the evaporator 231. The first partial flow rate 243 is then divided into a third flow rate 246 and a fourth flow rate 245. The third flow rate 246 is dependent from the third ORC cycle 250 and supplies the evaporator 251 and the pre-heater 255 in sequence, then rejoins with the fourth flow rate 245, which has supplied the pre-heater 235 of the second ORC cycle 230, by reconstituting the first flow rate 243. The second flow rate 242, on the other hand, continues to supply the first ORC cycle and in particular the pre-heater 225. Finally, the first partial flow rate 243 and the second partial flow rate 242 come together to form the full flow rate 240 which leaves the plant at the exit point 244.

In addition to the embodiments of the invention, as described above, it is to be understood that there are numerous further variants. It must also be understood that said embodiments are only examples and do not limit neither the object of the invention, nor its applications, nor its possible configurations. On the contrary, although the above description makes it possible for the skilled man to implement the present invention at least according to an exemplary configuration thereof, it must be understood that numerous variations of the components described are conceivable, without thereby departing from the object of the invention.

The invention claimed is:

1. An Organic Rankine cycle plant (10, 110, 210) with cascade cycles comprising a first organic Rankine cycle (20, 120, 220) which is configured to operate at high temperature, in which a first organic working fluid carries out a heat exchange with a hot source fluid and at least a second organic Rankine cycle (30, 130, 230, 250) which is configured to operate at a temperature lower than the temperature of the first organic Rankine cycle (20, 120, 220) and in which a second organic working fluid carries out a heat exchange with the same hot source fluid, each organic Rankine cycle (20, 120, 220, 30, 130, 230, 250) comprising:

at least a feed pump (24, 124, 224, 34, 134, 234, 254) configured to feed the organic working fluid in the liquid phase, at least a first preheater (25, 125, 225, 35, 135, 235, 255) configured to preheat the organic working fluid, at least an evaporator (21, 121, 221, 31, 131, 231, 251) configured to vaporize the organic working fluid, at least an expansion turbine (22, 122, 222, 32, 132, 232, 252) configured to expand the vapor of the organic working fluid, at least a condenser (23, 123, 223, 33, 133, 233, 253) configured to bring the organic working fluid back into the liquid phase, wherein the evaporator (21, 121, 221) of the first organic Rankine cycle (20, 120, 220) is configured to be fed by the full flow rate (40, 140, 240) of the hot source fluid, while the evaporator (31, 131, 231) and the preheater (35, 135, 235) of said at least one second organic Rankine cycle (30, 130, 230) are configured to be fed only by a first partial flow (43,143, 243) of the hot source fluid, the preheater (25, 125, 225) of said first organic Rankine cycle being configured to be fed only by a remaining second partial flow (42, 142, 242) of the hot source fluid.

2. The Organic Rankine cycle plant (110) according to claim 1, wherein the first organic Rankine cycle (120) comprises at least a second pre-heater (126) through which the hot source fluid is configured to flow at the full flow rate (140) after flowing through the evaporator (121);

and wherein the second pre-heater (126) is a heat exchanger having a substantial function of an additional pre-heater, not being intended to evaporate the fluid, but to preheat it with an increasing temperature greater than 2-5° C. with respect to the difference between the evaporation temperature and the inlet temperature of the first organic working fluid to be evaporated.

3. The Organic Rankine cycle plant (10, 110) according to claim 1, wherein said at least one second organic Rankine cycle (30, 130) is in a number exactly equal to one.

4. The Organic Rankine cycle plant (210) according to claim 1, wherein said at least one second organic Rankine cycle (230, 250) is equal to two or greater than two.

5. The Organic Rankine cycle plant (10, 110) according to claim 1, wherein the first organic working fluid and the second organic working fluid are configured to form a single working fluid flow.

6. The Organic Rankine cycle plant (10, 110) according to claim 1, wherein the expansion turbine (22, 122) of the first organic Rankine cycle (20, 120) and the expansion turbine (32, 132) of the second organic Rankine cycle (30,130) are a single turbine (22*a*) with two feeding levels (22*b*, 22*c*), configured to be fed by the first organic working fluid and by the second organic working fluid at two different pressure levels.

7. The Organic Rankine cycle plant (10, 110, 210) according to claim 1, wherein the first organic Rankine cycle (20, 120, 220) and the second organic Rankine cycle (30, 130, 230, 250) comprise at least one electric generator (27, 127, 227, 37, 137, 237, 257) operatively connected to the expansion turbine (22, 122, 222, 32, 132, 232, 252).

8. The Organic Rankine cycle plant (10, 110) according to claim 7, wherein the Organic Rankine plant (10, 110) comprises a single electric generator and the electric generator (27, 127) is connected to both turbines (22, 32; 122, 132) of the organic Rankine cycle plant (10, 110).

* * * * *